US011517912B2

(12) United States Patent
Aries et al.

(10) Patent No.: US 11,517,912 B2
(45) Date of Patent: Dec. 6, 2022

(54) DOCUMENT SHREDDER

(71) Applicant: ACCO UK Ltd., Aylesbury (GB)

(72) Inventors: Paul Aries, West Midlands (GB); Chloe Burton, Buckinghamshire (GB)

(73) Assignee: ACCO UK Ltd., Aylesbury (GB)

( * ) Notice: Subject to any disclaimer, the term of this patent is extended or adjusted under 35 U.S.C. 154(b) by 0 days.

(21) Appl. No.: 17/636,239

(22) PCT Filed: Jul. 29, 2020

(86) PCT No.: PCT/EP2020/071432
§ 371 (c)(1),
(2) Date: Feb. 17, 2022

(87) PCT Pub. No.: WO2021/058180
PCT Pub. Date: Apr. 1, 2021

(65) Prior Publication Data

US 2022/0266256 A1 Aug. 25, 2022

(30) Foreign Application Priority Data

Sep. 26, 2019 (DE) ..... 102019126015.9

(51) Int. Cl.
*B02C 18/00* (2006.01)
*B02C 18/22* (2006.01)

(52) U.S. Cl.
CPC ..... *B02C 18/2291* (2013.01); *B02C 18/0007* (2013.01); *B02C 18/2283* (2013.01)

(58) Field of Classification Search
CPC ..... B02C 18/0007; B02C 18/0015
See application file for complete search history.

(56) References Cited

U.S. PATENT DOCUMENTS 5,295,633 A * 3/1994 Kimbro ..... B02C 18/0007 241/166
2005/0274836 A1* 12/2005 Chang ..... B02C 18/0007 241/236

(Continued)

FOREIGN PATENT DOCUMENTS

DE 212011100081 U1 12/2012
DE 102014113862 A1 3/2015

(Continued)

OTHER PUBLICATIONS

International Preliminary Report on Patentability for Application No. PCT/EP2020/071432 dated Mar. 15, 2022 (5 pages).

(Continued)

*Primary Examiner* — Faye Francis
(74) *Attorney, Agent, or Firm* — Michael Best & Friedrich LLP

(57) ABSTRACT

A document shredder (10) includes a housing (12) which has, in a housing wall (18), an insertion slot (22) for inserting sheet material. The insertion slot (22) has a longitudinal extent between two slot ends (32). The shredder further includes a cutting unit which is arranged in the housing (12) and which has motor-driven cutting tools (24) for shredding the sheet material. The insertion slot (22) is widened transversely with respect to the longitudinal extent in at least one end region (38) that is delimited by one of the slot ends (32).

13 Claims, 4 Drawing Sheets

(56) References Cited

U.S. PATENT DOCUMENTS

| | | | | |
|---|---|---|---|---|
| 2007/0012808 | A1* | 1/2007 | Kao | B02C 18/0007 241/37.5 |
| 2008/0169369 | A1* | 7/2008 | Wang | B02C 18/2225 241/37.5 |
| 2008/0169370 | A1 | 7/2008 | Aries et al. | |
| 2009/0032629 | A1* | 2/2009 | Aries | B02C 18/0007 241/236 |
| 2009/0078804 | A1* | 3/2009 | Sued | B02C 19/0081 241/27 |
| 2012/0187230 | A1* | 7/2012 | Aries | G01B 21/08 241/36 |
| 2013/0161424 | A1* | 6/2013 | Pan | B02C 18/0007 241/34 |
| 2019/0193127 | A1* | 6/2019 | Chang | B08B 1/02 |
| 2020/0290056 | A1* | 9/2020 | Wang | B02C 18/0007 |
| 2022/0193689 | A1* | 6/2022 | Chang | B02C 18/2283 |

FOREIGN PATENT DOCUMENTS

| | | | |
|---|---|---|---|
| DE | 102017118889 | A1 | 2/2019 |
| GB | 2504785 | A | 2/2014 |
| JP | H0975762 | A | 3/1997 |

OTHER PUBLICATIONS

German Office Action for Application No. 2019126015.9 dated Jul. 15, 2020 (7 pages).

International Search Report and Written Opinion for Application No. PCT/EP2020/071432 dated Nov. 11, 2020 (10 pages, including English translation).

* cited by examiner

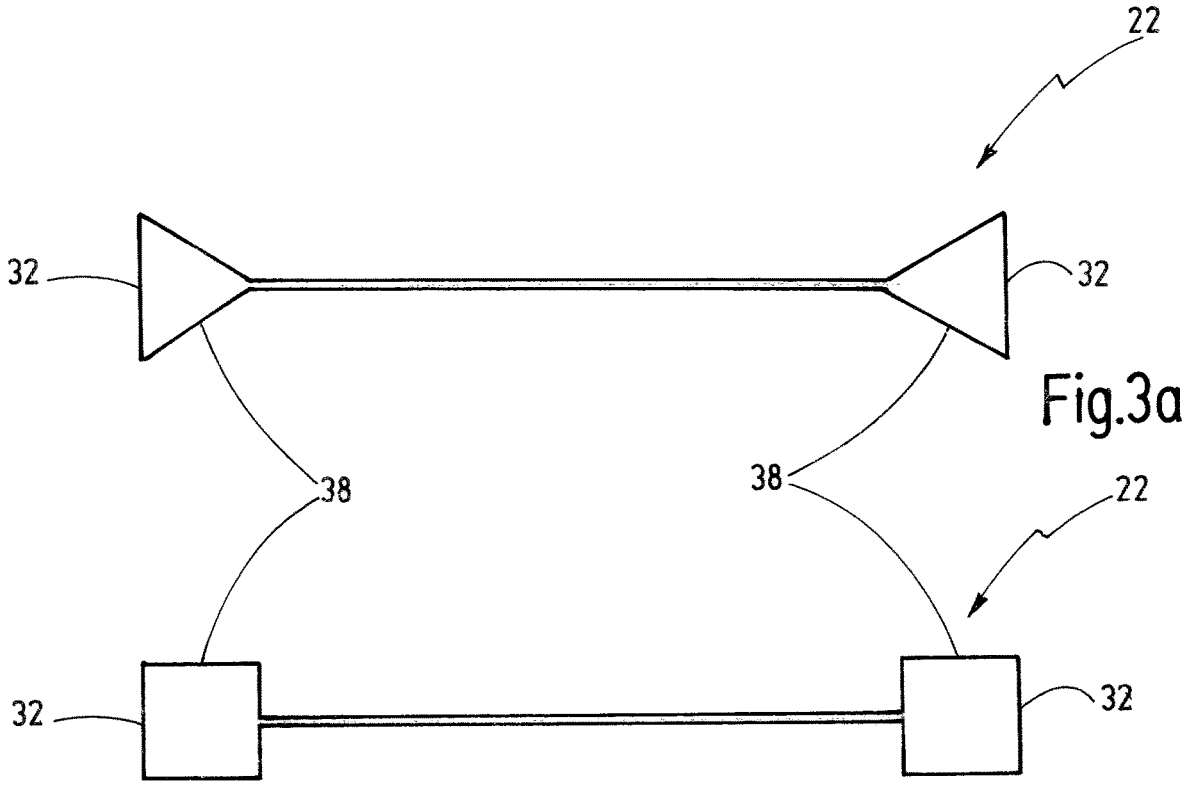
Fig.3a
Fig.3b
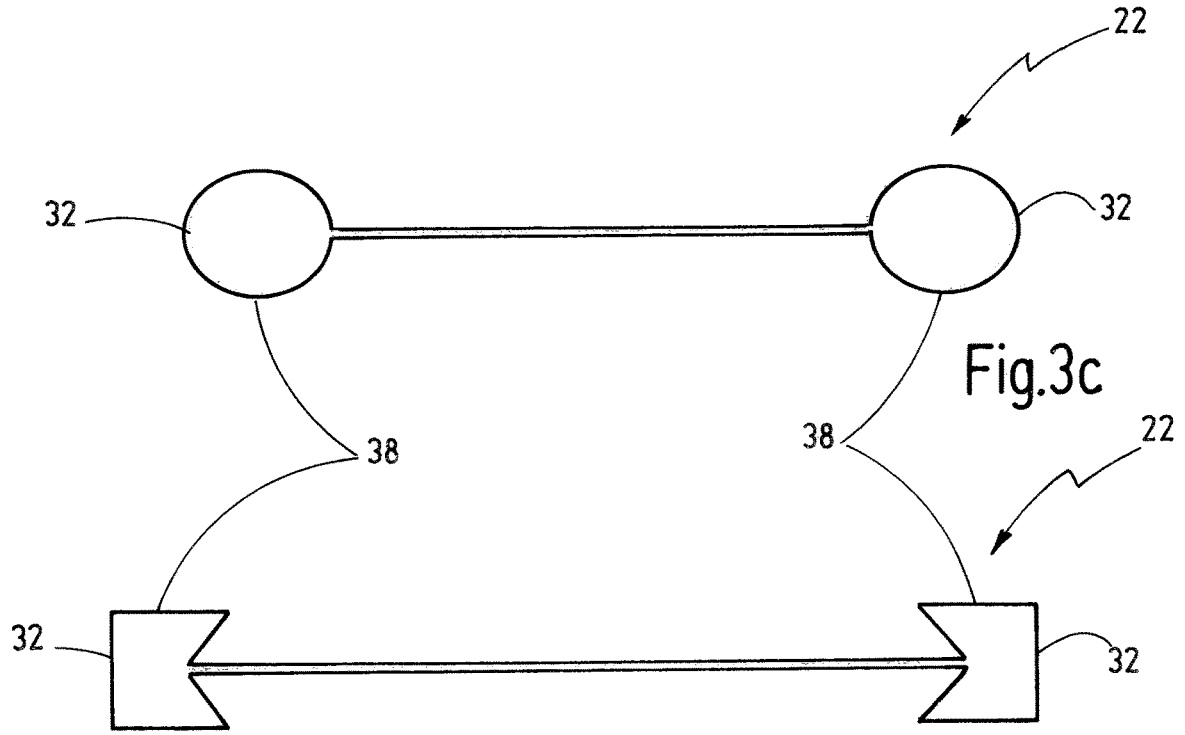
Fig.3c
Fig.3d

DOCUMENT SHREDDER

CROSS REFERENCE TO RELATED APPLICATIONS

This application is a national stage filing under 35 U.S.C. § 371 of International Patent Application No.: PCT/EP2020/071432, filed Jul. 29, 2020, which claims priority to German Patent Application No. 102019126015.9, filed Sep. 26, 2019, the entire contents of both are hereby incorporated by reference herein.

BACKGROUND

The invention relates to a document shredder.

Document shredders of the type stated at the outset are known in various embodiments. Thus, for example, DE 10 2017 118 889 A1 discloses such a document shredder of which the housing has, on its upper side in the cover wall, an insertion slot for manually inserting sheet material to be shredded.

Furthermore, document shredders with automatic sheet material draw-in are known (cf., for example, DE 10 2014 113 862 A1). The latter have a receiving compartment for receiving the sheet material, the insertion slot being situated in the bottom of said compartment. The sheet material received in the receiving compartment is grasped by draw-in rollers arranged on both sides of the insertion slot and is drawn into the insertion slot. The insertion slot can be arranged in the centre of the receiving compartment or off-centre. The problem exists in the case of the two described types of document shredders that, although the portions of folded sheet material arranged on both sides of the fold are pressed onto one another by the draw-in rollers and can be readily drawn into the insertion slot, the portions of the sheet material arranged on both sides of the fold project from one another in the regions next to the draw-in rollers and the drawing into the insertion slot is thus made more difficult. This disadvantage occurs particularly in the document shredders with automatic sheet material draw-in since, in these document shredders, the sheet material is always folded when being drawn in.

SUMMARY

It is therefore the object of the invention to further develop a document shredder of the type stated at the outset in such a way that the sheet material draw-in is improved.

BRIEF DESCRIPTION OF THE DRAWINGS

The invention is based on the idea of configuring the insertion slot to be wider at those points at which it is to be expected that the sheet material to be drawn in has a greater thickness. This is particularly the case in the regions in which the portions of folded sheet material arranged on both sides of the fold project further from one another. In this regard, it is possible that the insertion slot is widened only in one end region that is delimited by one of the slot ends. However, it is preferred that it is widened in both end regions. In particular, it is possible that the insertion slot widens transversely with respect to the longitudinal extent in one end region or in both end regions towards the respective slot end.

The sheet material draw-in can be carried out in that the sheet material is grasped by the cutting tools. However, it is preferred that the document shredder has at least two oppositely motor-driven draw-in rollers for drawing the sheet material into the insertion slot that are rotatably mounted in pairs between the housing wall and the cutting unit, wherein a nip extending parallel to the longitudinal extent for drawing through the sheet material is arranged between the draw-in rollers of a draw-in roller pair. In this regard, it is possible that the document shredder has only one draw-in roller pair. However, it is preferred that it has at least two draw-in roller pairs, wherein each draw-in roller pair has a first and a second draw-in roller and wherein the first draw-in rollers are mounted so as to be rotatable about a common first axis of rotation, and the second draw-in rollers are mounted so as to be rotatable about a common second axis of rotation, wherein the axes of rotation do not have to be formed continuously in a physical manner. Whereas the insertion slot widens transversely with respect to the longitudinal extent in the end regions towards the slot ends, it is preferred that the insertion slot has, in at least one central region which is arranged between the end regions, a constant width measured perpendicular to its longitudinal extent. The draw-in rollers are then preferably arranged between a central region and one of the end regions or between two central regions. The insertion slot can thus be configured to be narrow and of constant width in the regions in which the draw-in rollers ensure that the portions of folded sheet material situated on both sides of the fold are pressed onto one another.

The insertion slot expediently opens into a support surface of the housing wall on which the sheet material to be shredded can be laid, and the draw-in rollers extend up to the support surface by way of their lateral surfaces, or the lateral surfaces project beyond the support surface. This measure facilitates gripping of the sheet material by means of frictional engagement between the draw-in rollers and the sheet material. The frictional engagement can be intensified by a pressure piece pressing onto the sheet material stack in the direction of the support surface.

It is possible that the insertion slot is widened in the end regions towards the slot ends in one or more steps. However, it is preferred if it widens continuously at least in certain portions and at the same time preferably has rectilinear boundary lines. In addition, it is preferred that the end regions are formed identically and are situated opposite to one another in mirror-symmetrical fashion, while the insertion slot is additionally preferably mirror-symmetrical with respect to a centre line extending in its longitudinal extent.

A further improvement of the sheet material draw-in is obtained if, according to one advantageous development of the invention, the insertion slot is delimited on its longitudinal sides at least somewhat in the direction of the cutting unit by guide elements. The spacing of the guide elements is advantageously at least partially reduced towards the cutting unit such that portions of the sheet material initially projecting from one another are pressed together more and more in order to reduce their thickness the closer they come to the cutting unit.

Figure 1:
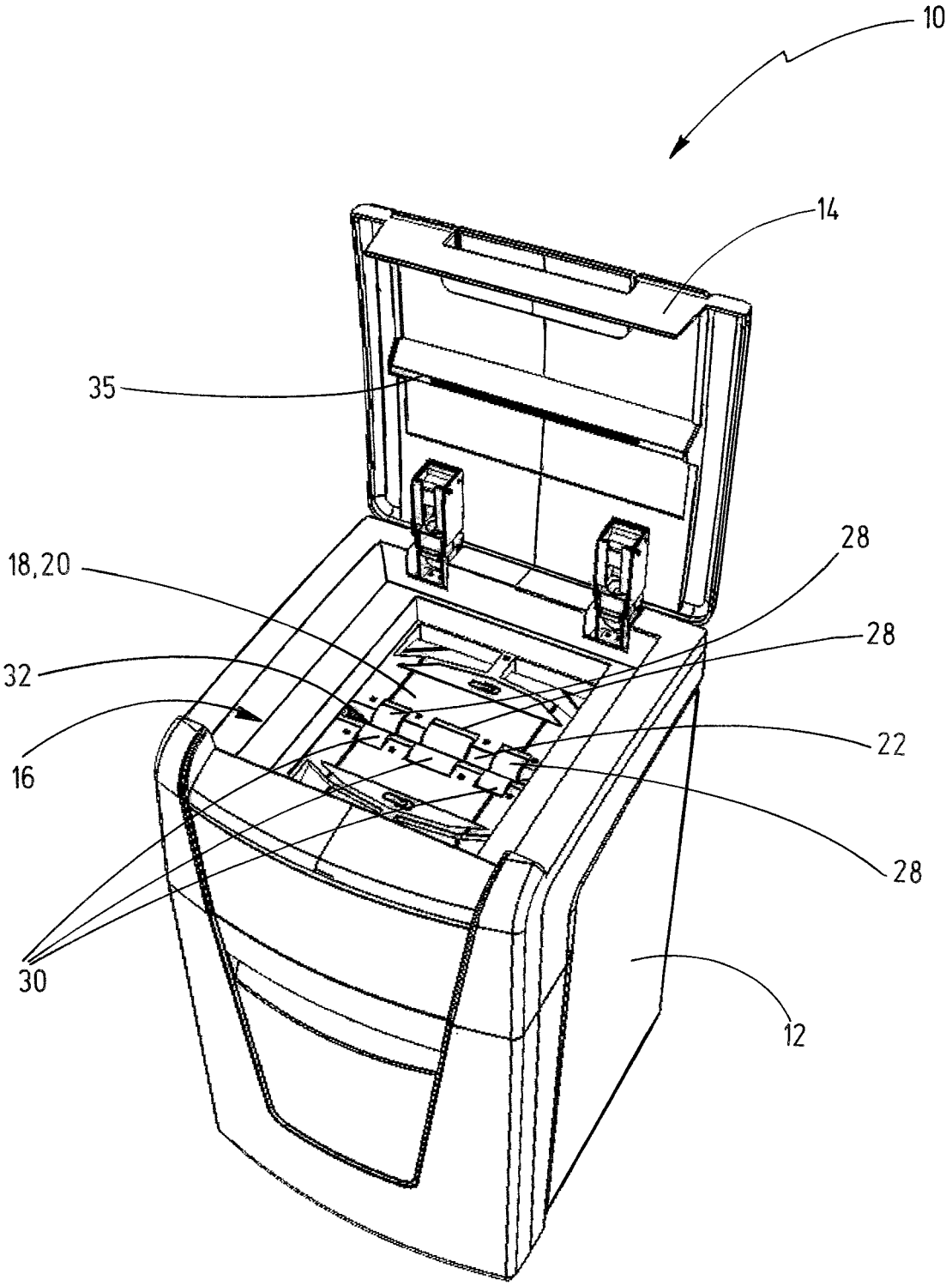
Figure 2A:
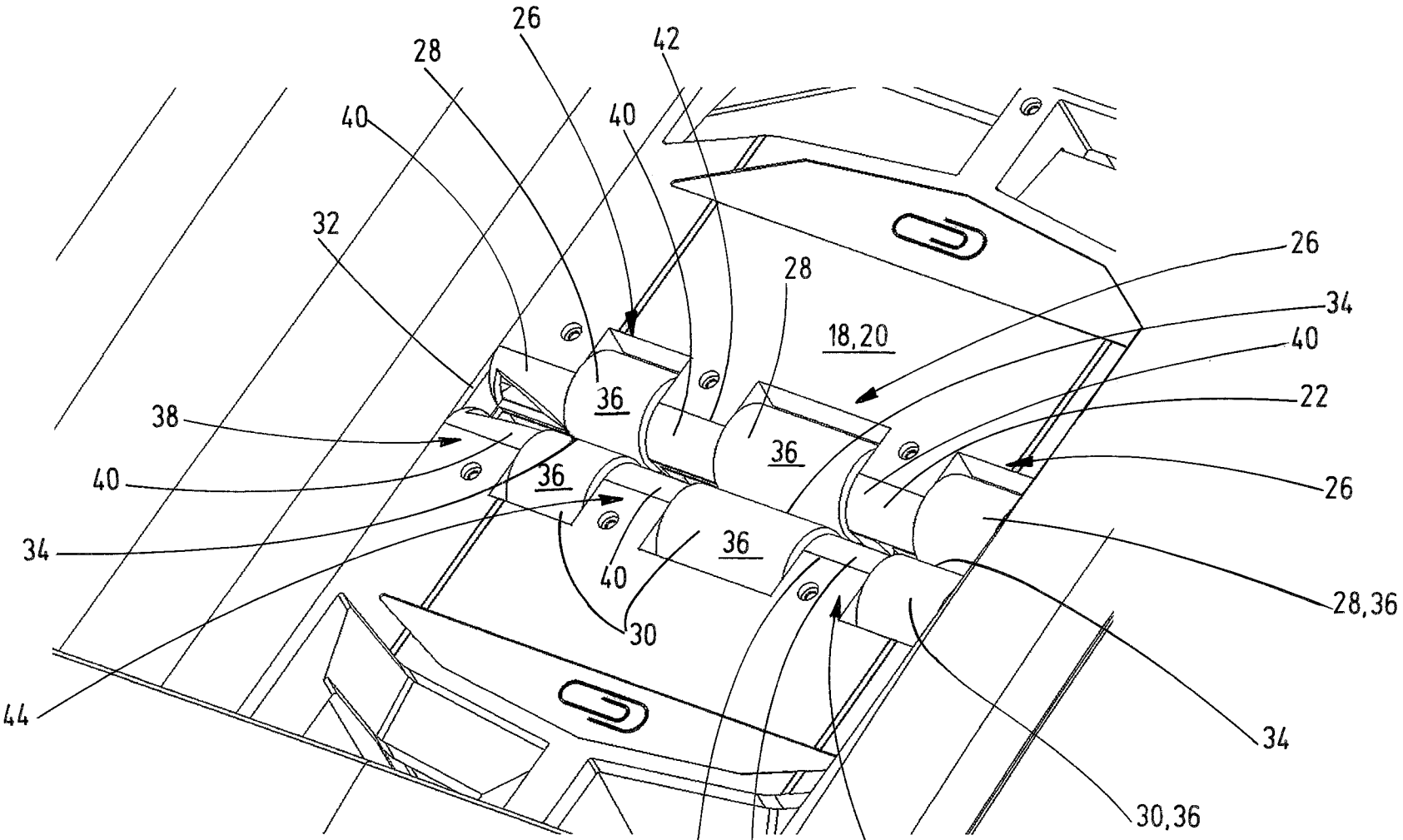
Figure 2B:
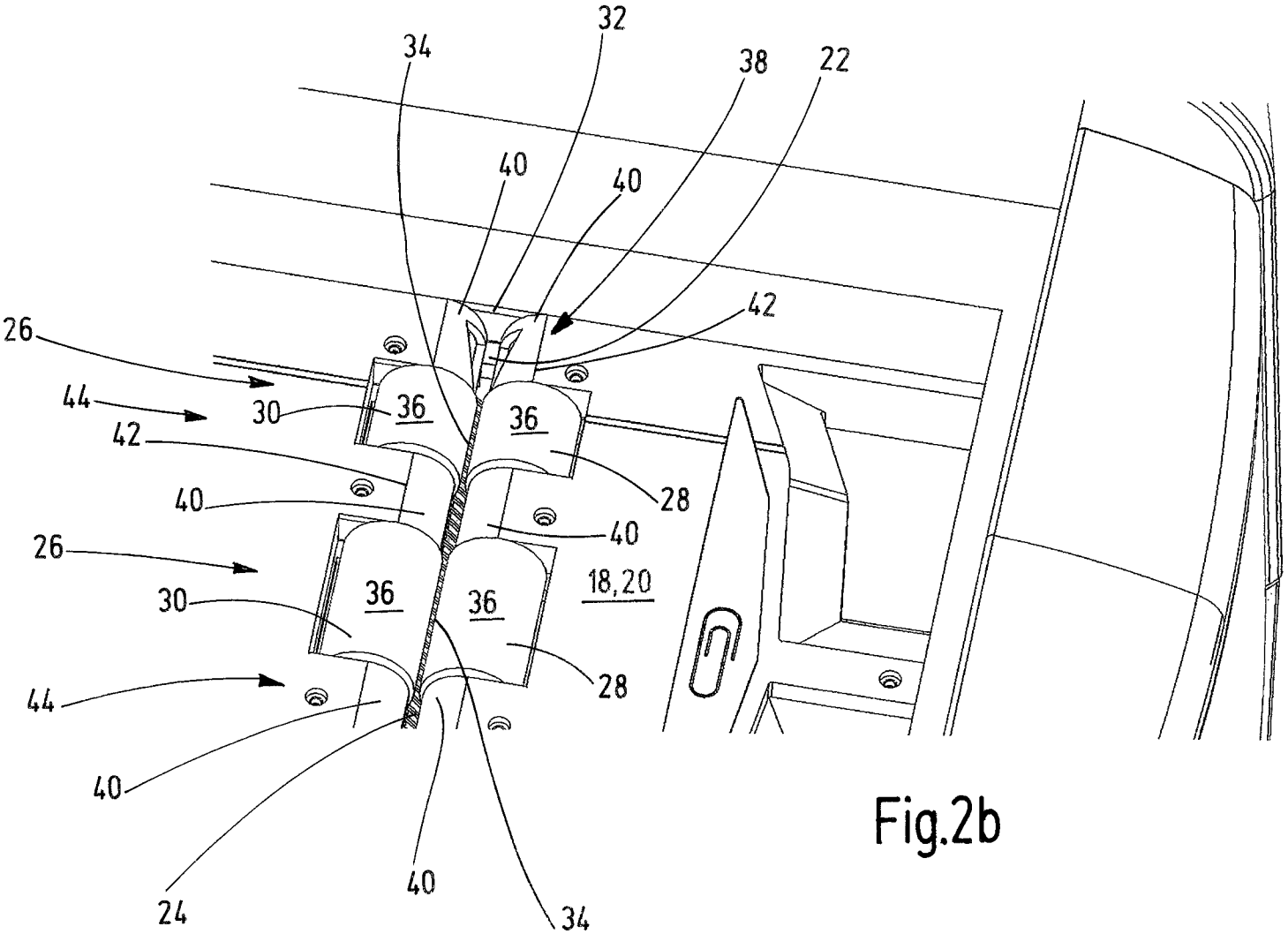

The invention will be explained in more detail below on the basis of an exemplary embodiment schematically illustrated in the drawing, in which FIG. 1 shows a document shredder in perspective view;

FIGS. 2*a*, 2*b* show detail illustrations of the document shredder according to FIG. 1, and FIGS. 3*a*-3*d* show schematic illustrations of alternative geometries of the insertion slot in a top view.

DETAILED DESCRIPTION

The document shredder 10 illustrated in the drawing has a housing 12 which has, on its upper side, a cover 14 articulated by means of hinges. Below the cover 14 is situated a receiving compartment 16 for sheet material, which is accessible when the cover is opened, with the result that sheet material can be inserted, as illustrated in FIG. 1. The bottom of the receiving compartment 16 is formed by a housing wall 18 whose upper side serves as a support surface 20 for the sheet material. In the housing wall 18 there is situated an insertion slot 22 through which sheet material lying on the support surface 20 can be drawn in and fed to a cutting unit (not shown in detail) which is arranged in the housing 12 below the housing wall 18 and of which the cutting tools 24 are indicated in FIG. 2*b*. The document shredder 10 additionally has three draw-in roller pairs 26 which each have a first draw-in roller 28 and a second draw-in roller 30. These are each mounted so as to be rotatable about an axis of rotation arranged above the cutting unit and below the housing wall 18, wherein the first draw-in rollers 28 are rotatable about a common first axis of rotation, and the second draw-in rollers 30 are rotatable about a common second axis of rotation. The axes of rotation each extend parallel to a longitudinal extent of the insertion slot 22 that extends between the two slot ends 32 which form the narrow sides of the insertion slot 22. Between the first draw-in roller 28 and the second draw-in roller 30 of each of the draw-in roller pairs 26 there is situated a nip 34 through which the sheet material is drawn and fed to the cutting tools 24. The lateral surfaces 36 of the draw-in rollers 28, 30 project somewhat beyond the support surface 20, with the result that the sheet material lies directly on them and can be grasped by frictional engagement. A pressure piece 35 on the cover 14 that presses onto the sheet material stack improves the frictional engagement. The first draw-in rollers 28 rotate oppositely to the second draw-in rollers 30, and the draw-in rollers 28, 30 are driven by means of the same motor as the cutting tools 24.

When the sheet material is being drawn in by means of the draw-in rollers 28, 30, in each case the lowermost sheet is grasped by the draw-in rollers 28, 30, folded approximately in its centre and drawn into the insertion slot 22 with the fold leading. The two portions of a sheet which adjoin one another at the fold are pressed tightly against one another in the region of the nips 34 by the draw-in rollers 28, 30, whereas they project further from one another in the region of the slot ends 32. In order to facilitate insertion into the insertion slot 22 at that point too, there is provision according to the invention that the insertion slot 22 widens transversely with respect to the longitudinal extent in two end regions 38 towards the slot ends 32. This widening occurs continuously, as illustrated in FIGS. 2*a*, 2*b*. Here, the insertion slot 22 is mirror-symmetrical with respect to a centre plane extending perpendicular to its longitudinal extent and additionally mirror-symmetrical in relation to a centre line extending in its longitudinal extent. In addition, guide elements 40 extend from the housing wall 18 somewhat in the direction of the cutting tools 24 and delimit the insertion slot 22 on both sides starting from its longitudinal sides 42 in the support surface 20 which extend parallel to the longitudinal extent. The width of the insertion slot 22 is constant in central regions 44 arranged between the end regions 38, wherein the draw-in rollers 28, 30 are each arranged between one of the central regions 44 and one of the end regions 38 or between two central regions 44, with the result that the longitudinal sides 42 do not extend continuously. The guide elements 40 extend somewhat towards one another in the direction of the cutting tools 24, with the result that the insertion slot is narrowed towards the cutting elements 24.

In FIGS. 3*a* to 3*d*, four different geometries of the insertion slot 22 are shown schematically. According to FIG. 3*a*, the insertion slot 22 widens continuously in its end regions 38 towards the slot ends 32, whereas it widens in one step in both end regions 38 according to FIG. 3*b* and it has approximately circular end regions 38 according to FIG. 3*c*. Finally, according to FIG. 3*d*, it widens in a direction away from the slot ends 32.

In summary, the following can be stated: The invention relates to a document shredder 10 with a housing 12 which has, in a housing wall 18, an insertion slot 22 for inserting sheet material, wherein the insertion slot 22 has a longitudinal extent between two slot ends 32, and with a cutting unit which is arranged in the housing 12 and which has motor-driven cutting tools 24 for shredding the sheet material. According to the invention, there is provision that the insertion slot 22 is widened transversely with respect to the longitudinal extent in at least one end region 38 that is delimited by one of the slot ends 32.

The invention claimed is:

1. A document shredder comprising:

a housing which has, in a housing wall, an insertion slot for inserting sheet material, wherein the insertion slot has a longitudinal extent between two slot ends, and a cutting unit which is arranged in the housing and which has motor driven cutting tools for shredding the sheet material, wherein the insertion slot is widened transversely with respect to the longitudinal extent in at least one end region that is delimited by one of the slot ends.

2. The document shredder according to claim 1, wherein the insertion slot is widened in both end regions transversely with respect to the longitudinal extent.

3. The document shredder according to claim 1, wherein the insertion slot widens transversely with respect to the longitudinal extent in at least one of the end regions towards the respective slot end.

4. The document shredder according to claim 1, further comprising at least two oppositely motor driven draw-in rollers for drawing the sheet material into the insertion slot, the draw-in rollers being rotatably mounted in one or more draw-in roller pairs between the housing wall and the cutting unit, wherein a nip extending parallel to the longitudinal extent for drawing through the sheet material is arranged between the draw-in rollers of a draw-in roller pair.

5. The document shredder according to claim 4, further comprising at least two draw-in roller pairs, wherein each draw-in roller pair has a first draw-in roller and a second draw-in roller, and wherein the first draw-in rollers are mounted so as to be rotatable about a common first axis of rotation, and the second draw-in rollers are mounted so as to be rotatable about a common second axis of rotation.

6. The document shredder according to claim 1, wherein the insertion slot has, in at least one central region between the end regions, a constant width measured perpendicular to the longitudinal extent.

7. The document shredder according to claim 4, wherein the draw-in rollers are arranged between a central region and one of the end regions or within a central region.

8. The document shredder according to claim 7, wherein the insertion slot opens into a support surface of the housing wall for supporting sheet material, and in that the draw-in rollers extend up to the support surface by way of lateral surfaces of the draw-in rollers, or wherein lateral surfaces of the draw-in rollers project beyond the support surface.

9. The document shredder according to claim 1, wherein the insertion slot widens continuously in the end regions towards the slot ends.

10. The document shredder according to claim 1, wherein end regions delimited by the respective slot ends are formed identically and are situated opposite to one another in mirror symmetrical fashion.

11. The document shredder according to claim 1, wherein the insertion slot is mirror symmetrical with respect to a center line extending along the longitudinal extent.

12. The document shredder according to claim 1, wherein the insertion slot is at least partially delimited on its longitudinal sides, the direction of the cutting unit, by guide elements.

13. The document shredder according to claim 12, wherein a spacing of the guide elements reduces at least partially towards the cutting unit.

* * * * *